United States Patent [19]

Ward et al.

[11] 3,963,434

[45] June 15, 1976

[54] CARBOXYMETHYLATED COTTON FABRIC WITH IMPROVED CONDITIONED AND WET WRINKLE RECOVERY BY REACTION WITH PROPYLENE OR ETHYLENE CARBONATE

[75] Inventors: Truman L. Ward; Ruth R. Benerito; Dorothy M. Perrier, all of New Orleans, La.

[73] Assignee: The United States of America as represented by the Secretary of Agriculture, Washington, D.C.

[22] Filed: July 23, 1975

[21] Appl. No.: 598,494

[52] U.S. Cl. ..... 8/120; 8/129; 8/DIG. 11

[51] Int. Cl.[2] ..... D06M 13/10; D06M 13/54

[58] Field of Search ..... 8/120, 129, DIG. 11

[56] References Cited

UNITED STATES PATENTS

| | | | |
|---|---|---|---|
| 3,617,197 | 11/1971 | Ulrich | 8/116.3 |
| 3,918,899 | 11/1975 | Perrier et al. | 8/120 |

*Primary Examiner*—John Kight, III

*Attorney, Agent, or Firm*—M. Howard Silverstein; Max D. Hensley

[57] ABSTRACT

Partially carboxymethylated-cotton fabric prepared by a non-aqueous procedure is reacted with either ethylene carbonate or propylene carbonate in a heated, evacuated oven. The product of either reaction is a fabric with high conditioned and high wet wrinkle recovery.

4 Claims, No Drawings

CARBOXYMETHYLATED COTTON FABRIC WITH IMPROVED CONDITIONED AND WET WRINKLE RECOVERY BY REACTION WITH PROPYLENE OR ETHYLENE CARBONATE

This invention relates to chemical treatment of cotton textiles to impart improved physical characteristics. More specifically, this invention relates to chemical modification of cotton fabric which has been partially carboxymethylated in a non-aqueous process. The carboxymethylated cotton fabric is further reacted with propylene carbonate or with ethylene carbonate to obtain a fabric with both high conditioned (dry) and high wet wrinkle recovery, as measured by ASTM approved methods.

APPLICABLE EQUATION - A representation of the pertinent reaction would be thus:

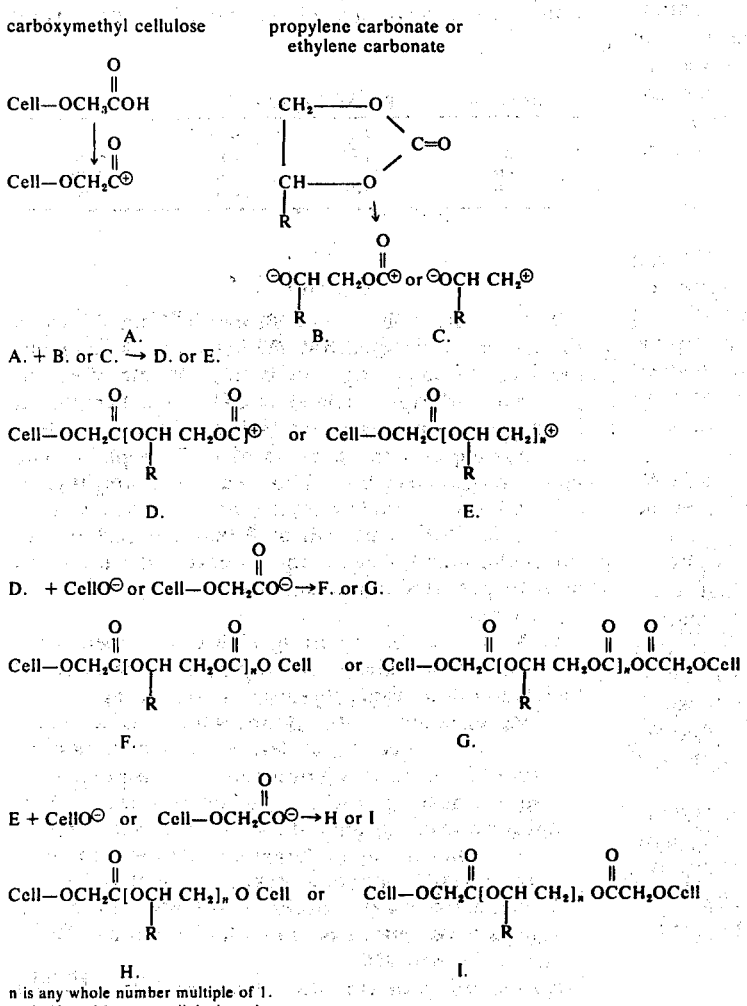

n is any whole number multiple of 1.
F, G, H, and I are crosslinked products.
Cell O⁻ is the cellulosate ion.
R is hydrogen for ethylene carbonate and $CH_3$ for propylene carbonate.

The main object of this invention is to provide a process for modifying partially carboxymethylated cotton fabric to yield a product having high conditioned (dry) and high wet wrinkle recovery.

Another object of this invention is to provide a process for reacting carboxymethylated cotton with a heterocyclic carbonate to form ester crosslinks of varying lengths between carboxymethyl groups on different cellulose chains or between a carboxymethyl group and an unreacted hydroxyl group of a different cellulosic chain.

We have now discovered that cotton fabric which has been carboxymethylated by a non-aqueous procedure can be reacted with a heterocyclic carbonate (ethylene carbonate, propylene carbonate, or both) to produce chemically modified cotton cellulose fabric having good dry and wet wrinkle recovery. We have further discovered that the carboxymethyl-cotton starting material must have been produced by non-aqueous means in order to be able to obtain a product with both high dry and high wet wrinkle recovery. Use of carboxymethyl-cotton prepared aqueously gives only improved conditioned wrinkle recovery. The reaction proceeds in a heated vacuum oven without catalyst to yield carboxymethylated-cotton having ester crosslinks. The combination of heat and vacuum induces reaction and removes water formed by the condensation reaction.

For the process of this invention cotton fabric carboxymethylated by non-aqueous means, as described in "Properties of Carboxymethylated-Cotton Prepared in Non-Aqueous Media," an article by D. M. Perrier and R. R. Benerito, which appears in the Journal of Polymer Science, Vol. 17(11), November 1973, was deemed most suitable. Investigative studies have indicated that aqueous processes do not yield carboxymethylated cotton suitable as starting material for the present invention.

By the process of the present invention the carboxymethylated cotton fabric is padded with the neat selected cyclic carbonate to about 100% takeup. The cyclic carbonate may be either ethylene carbonate (1,3 dioxol-2-one) or propylene carbonate (4-methyl 1,3 dioxol-2-one), or it may be a mixture of these. The padded, wet fabric is placed into a heated vacuum oven.

The preferred temperature of the process of this invention is about from 160° to 180°C. Temperatures above 180° tend to discolor the fabric. The heated oven containing the fabric is evacuated to a pressure of about 35 mm of mercury, and the evacuation continued during the reaction period. This process of heat and vacuum induces reaction and removes water produced in the reaction. By the process of this invention, the vacuum and heat are maintained in the oven for about from 30 to 120 minutes after which the vacuum is released, the sample removed from the oven and washed with water to remove unreacted material.

The following examples are provided to illustrate the invention.

EXAMPLE 1

Cotton printcloth of 80 × 80 unmodified thread count was partially carboxymethylated by the method of Perrier and Benerito to a degree of substitution of 0.3 (D.S. = 0.3). This was padded in neat propylene carbonate to 100% takeup, by weight. The padded fabric was placed in a vacuum oven preheated to 180°C, and the oven was evacuated to a pressure of 35 mm mercury (Hg).

The temperature and vacuum were maintained for 60 minutes. At the end of the 60 minute reaction period the vacuum was released, the fabric was removed, washed and dried. The fabric had gained 0.3% in weight. Infrared (IR) spectra indicated that ester groups had been added and that reaction had occurred at the carboxymethyl groups. Dry wrinkle recovery was 297 (W+F)° and wet recovery was 285 (W+F)°. These values, compared to the unmodified cotton, which were 180° and 172°, respectively, were an improvement, obviously. The color of the treated fabric was white.

Further investigation indicated that ethylene carbonate, and a mixture of ethylene and propylene carbonate yield the same results as those obtained for the propylene carbonate. The testing procedure was that recommended by ASTM Specification D-1295-67, Philadelphia, Pa., 1967.

EXAMPLE 2

The technique of Example 1 was employed, using a carboxymethylated cotton fabric which had a D.S. of 0.1, rather than 0.3. The resultant product had a dry wrinkle recovery of 272° and wet recovery of 260°. The color of the treated fabric was white. The fabric gained 0.2% in weight and the IR spectra indicated that ester groups had been added and that reaction occurred at the carboxymethyl groups.

EXAMPLE 3

The technique of Example 1 was employed, using a carboxymethylated cotton fabric with a D.S. of 0.3, except that temperatures of 160° and 200°C were employed, rather than 180°C. The resultant products had the following properties:

| Temp., °C | Wrinkle Recovery (W+F)° | | Color |
|---|---|---|---|
| | Dry | Wet | |
| 160°C | 248 | 281 | White |
| 200°C | 280 | 288 | Brown |

The results indicate that 200°C was too hot as it turned the fabric brown and 160°C somewhat low requiring additional reaction time requirement. 180°C is optimum.

EXAMPLE 4

The carboxymethylated cotton fabric of Example 1 was employed again (D.S. of 0.3) using the temperature of 180°C and reaction times of 30, 60, and 120 minutes, and the products had the following properties:

| Time, min. | Wrinkle Recovey (W+F)° | | Color |
|---|---|---|---|
| | Dry | Wet | |
| 30 | 271 | 281 | White |
| 60 | 297 | 285 | White |
| 120 | 306 | 288 | Grey |

EXAMPLE 5

To illustrate differences in properties obtained when the cotton fabric is carboxymethylated in an aqueous medium, the same original cotton printcloth of Example 1 was carboxymethylated to a D.S. of 0.3 employed in an aqueous process. This carboxymethylated fabric was treated with the same steps of Example 1. The fabric thus treated showed no measurable weight gain, and had a dry wrinkle recovery of 204° and a wet recovery of 190°. This indicates that the carboxymethylated-cotton utilized in the process of this invention must be prepared non-aqueously.

We claim:

1. A process for imparting high conditioned (dry) and high wet wrinkle recovery to partially carboxymethylated-cotton fabric, the process comprising:

a. impregnating a cotton fabric which has been carboxymethylated to a degree of substitution of about from 0.1 to 0.3 by a non-aqueous procedure, with a neat heterocyclic carbonate selected from the group consisting of ethylene carbonate, propylene carbonate, and a mixture of ethylene and propylene carbonate, to a pickup of about 100%, b. placing the wet, impregnated CMC fabric in a vacuum oven preheated to a temperature of about from 160° to 180°, c. evacuating the oven to obtain a pressure of about 35 mm of mercury, d. maintaining the temperature and vacuum for about from 30 to 120 minutes to obtain reaction, and e. releasing the vacuum and washing the reacted fabric to remove all unreacted material.

2. The process of claim 1 wherein the heterocyclic carbonate is ethylene carbonate.

3. The process of claim 1 wherein the heterocyclic carbonate is propylene carbonate.

4. The process of claim 1 wherein the heterocyclic carbonate is a mixture of ethylene and propylene carbonate.

* * * * *